US010155390B2

(12) United States Patent
Kearns et al.

(10) Patent No.: US 10,155,390 B2
(45) Date of Patent: Dec. 18, 2018

(54) AEROSOL CONTROL IN A PRINTER

(71) Applicant: Hewlett-Packard Development Company, L.P., Houston, TX (US)

(72) Inventors: James Kearns, Corvallis, OR (US); Joe Santich, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/543,538

(22) PCT Filed: Apr. 20, 2015

(86) PCT No.: PCT/US2015/026593
§ 371 (c)(1),
(2) Date: Jul. 13, 2017

(87) PCT Pub. No.: WO2016/171645
PCT Pub. Date: Oct. 27, 2016

(65) Prior Publication Data

US 2018/0001648 A1 Jan. 4, 2018

(51) Int. Cl.

| | |
|---|---|
| ***B41J 2/17*** | (2006.01) |
| ***B41J 2/21*** | (2006.01) |
| ***B41J 2/165*** | (2006.01) |
| ***B41J 2/215*** | (2006.01) |
| *B41J 11/00* | (2006.01) |
| *B41J 3/60* | (2006.01) |
| *B41J 15/04* | (2006.01) |

(52) U.S. Cl.
CPC ..... *B41J 2/1714* (2013.01); *B41J 2/165* (2013.01); *B41J 2/215* (2013.01); *B41J 2/2114* (2013.01); *B41J 2/2146* (2013.01); *B41J 2/16585* (2013.01); *B41J 3/60* (2013.01); *B41J 11/002* (2013.01); *B41J 15/04* (2013.01); *B41J 2002/16591* (2013.01)

(58) Field of Classification Search
CPC ..... B41J 2/1714; B41J 2/16585
See application file for complete search history.

(56) References Cited

U.S. PATENT DOCUMENTS

| | | | | |
|---|---|---|---|---|
| 5,774,141 | A | 6/1998 | Cooper et al. | |
| 5,915,304 | A * | 6/1999 | Stiel | B41F 23/0423 101/416.1 |
| 6,305,772 | B1 | 10/2001 | Berkoben et al. | |

(Continued)

FOREIGN PATENT DOCUMENTS

| | | |
|---|---|---|
| CN | 101314283 | 12/2008 |
| JP | 2005212323 | 8/2005 |

(Continued)

OTHER PUBLICATIONS

Unknown, "Ink Mist Absorbing Function", UJINUS, May 3, 2015, 4 pages, Retrieved from internet http://www.ujinus.com/?pgname=home/servicecenter_uvled.

*Primary Examiner* — John P Zimmermann
(74) *Attorney, Agent, or Firm* — HP Inc. Patent Department

(57) ABSTRACT

In one example, an aerosol control system for a printer includes an air knife to discharge a sheet of air into a flow of aerosol along a moving print substrate web and a vacuum near the air knife to suck up aerosol from the flow simultaneously with the air knife discharging air into the flow.

13 Claims, 6 Drawing Sheets

(56) References Cited

U.S. PATENT DOCUMENTS

| | | | | |
|---|---|---|---|---|
| 7,052,124 | B2 | 5/2006 | Pickup | |
| 8,177,316 | B2 | 5/2012 | Muto | |
| 2004/0245711 | A1* | 12/2004 | Domoto | B65H 29/242 271/197 |
| 2006/0238561 | A1 | 10/2006 | Carcia et al. | |
| 2007/0040886 | A1 | 2/2007 | Cellura et al. | |
| 2010/0208020 | A1 | 8/2010 | Matsumoto | |
| 2011/0109693 | A1* | 5/2011 | Ohnishi | B41J 2/18 347/34 |
| 2012/0033016 | A1 | 2/2012 | Stadler | |
| 2014/0168312 | A1 | 6/2014 | Mizes et al. | |
| 2015/0085014 | A1* | 3/2015 | Ishida | B41J 2/1714 347/34 |
| 2015/0165770 | A1* | 6/2015 | Miyakoshi | B41J 2/1714 347/34 |
| 2015/0273835 | A1* | 10/2015 | Arimizu | B41J 2/16585 347/30 |

FOREIGN PATENT DOCUMENTS

| | | |
|---|---|---|
| JP | 2007136725 | 6/2007 |
| WO | WO-2014070140 | 5/2014 |

* cited by examiner

AEROSOL CONTROL IN A PRINTER

BACKGROUND

Inkjet printers utilize printheads that include an array of hundreds or thousands of small nozzles through which drops of ink and other printing fluids are expelled on to a paper or other print substrate. Tiny particles of printing fluid generated during inkjet printing may accumulate as an aerosol in the air over the print substrate and around the printheads.

BRIEF DESCRIPTION OF THE DRAWINGS

The same part numbers designate the same or similar parts throughout the figures. The figures are not necessarily to scale.

DESCRIPTION

In large commercial inkjet web printers, commonly referred to as inkjet web presses, a continuous web moves past a series of stationary inkjet printheads that dispense ink and other printing fluid on to the moving web. The moving web entrains air and aerosol that surrounds the web. Aerosol carried along the web can interfere with the performance of downstream printheads. For some types of inks and print substrates, it is desirable to treat the print substrate with a chemical bonding agent that helps the ink adhere properly to the substrate. Bonding agents may be applied just like ink, with printheads positioned near the ink printheads. Aerosol generated dispensing bonding agents on to the web presents particular risks because, by its very nature, bonding agent aerosol can create unwanted chemical interactions that clog nozzles on downstream ink printheads.

A new aerosol control system has been developed to help control bonding agent and other aerosols in an inkjet printer. In one example, air is sucked off the top of a moving web or other print substrate into a vacuum duct simultaneously with blowing air at the intake to the vacuum duct and upstream into the moving substrate. The blowing air interrupts the flow and entrainment of aerosol at the vacuum intake, thus allowing more time to more easily suck up aerosol into the vacuum duct. Also, the blowing air dilutes any aerosol that escapes the vacuum duct to help minimize the risk that the aerosol will degrade downstream printheads. This and other examples shown in the figures and described herein illustrate but do not limit the scope of the patent, which is defined in the Claims following this Description.

As used in this document, an "air knife" means a duct or plenum with an elongated outlet configured to discharge a sheet of air when the duct or plenum is pressurized.

Figure 1:
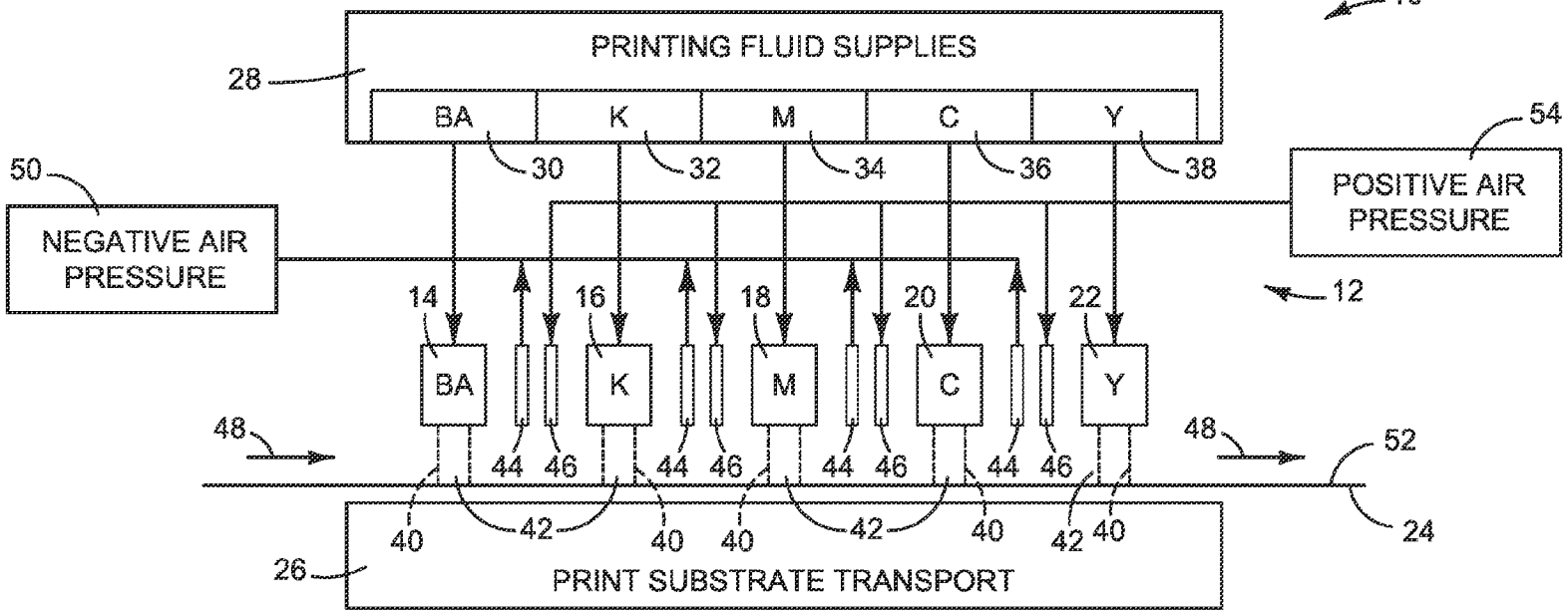
FIG. 1 illustrates an inkjet printer implementing one example of an aerosol control system.

FIG. 1 is a block diagram illustrating an inkjet printer 10 implementing one example of an aerosol control system 12.

Referring to FIG. 1, printer 10 includes aerosol control system 12, printheads 14, 16, 18, 20, 22, a print substrate 24, a print substrate transport 26 and a supply 28 of printing fluids 30, 32, 34, 36, 38. Printheads 14-22 dispense printing fluids 30-38 on to print substrate 24, for example as drops or streams 40, as substrate 24 moves through a print zone 42 past each printhead 14-22 at the urging of transport 26. The printing fluids may include, for example, a bonding agent (BA) 30, black ink (K) 32, magenta ink (M) 34, cyan ink (C) 36, and yellow ink (Y) 38.

Aerosol control system 12 includes a vacuum duct 44 and a pressure duct 46 between each pair of adjacent printheads 14-22. Each pressure duct 46 is positioned downstream from the corresponding vacuum duct 44 in the direction 48 substrate 24 moves past printheads 14-22. Each vacuum duct 44 is connected to a source of negative air pressure 50 to suck air away from the printed side 52 of a substrate 24 leaving a print zone 42. Each pressure duct 46 is connected to a source of positive pressure 54 to blow air on to the printed side 52 of substrate 24 leaving a print zone 42. The blowing air impedes the flow of aerosol along the moving substrate 24 near each intake to a vacuum duct 44 to allow more time to remove aerosol between printheads 14-22. Although vacuum and pressure ducts 44, 46 are shown between each pair of adjacent printheads 14-22 in FIG. 1, other configurations are possible.

Figure 2:
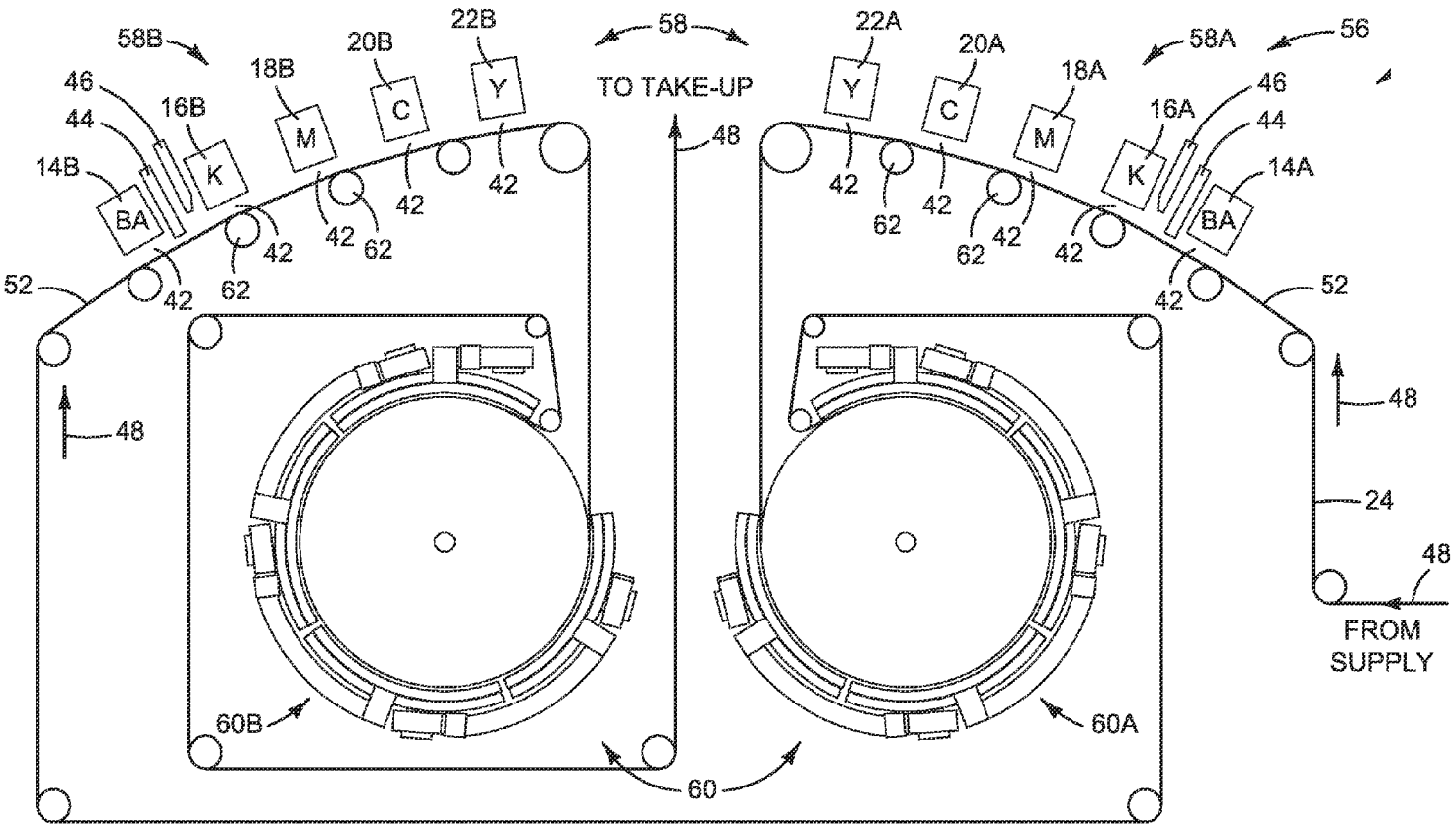
FIG. 2 illustrates an inkjet web printer implementing one example of an aerosol control system.

FIG. 2 illustrates an inkjet web printer 10 implementing one example of an aerosol control system 12. Referring to FIG. 2, printer 10 includes a web supply (not shown) from which a print substrate web 24 is fed to a printing station 56 and a web take-up (not shown) to which web 24 is taken after passing through printing station 56. Printing station 56 includes an arched printing unit 58 and a dryer 60 positioned under and contained within the footprint of arched printing unit 58.

Arched printing unit 58 includes a first printing unit 58A for printing on one side of web 24 and a second printing unit 58B for printing on the other side of web 24. First printing unit 58A includes a first series of printheads 14A-22A arranged along an arc on one side of arched printing unit 58. Second printing unit 58B includes a second series of printheads 14B-22B arranged along an arc on the other side of arched printing unit 58. In one example, printheads 14A-22A and 14B-22B dispense a bonding agent (BA), black (K) ink, magenta (M) ink, cyan (C) ink, and yellow (Y) ink. Dryer 60 includes a first dryer 60A for drying one side of web 24 and a second dryer 60B for drying the other side of web 24.

In the example shown in FIG. 2, aerosol control system 12 includes a vacuum duct 44 and a pressure duct 46 only between bonding agent (BA) printheads 14A, 14B and black (K) printheads 16A, 16B—downstream from bonding agent (BA) printheads 14A, 14B and upstream from black (K) printheads 16A, 16B. As noted above, aerosol generated while dispensing a bonding agent presents particular risks because, by its very nature, bonding agent aerosol entrained by a fast moving web 24 can create unwanted chemical interactions that clog nozzles on the downstream black (K) ink printheads 16A, 16B. Thus, it usually will be desirable to utilize aerosol control ducts 44, 46 after a bonding agent (BA) printhead 14A, 14B even if they are not used downstream from the ink printheads 16A-22A, 16B-22B. As described in more detail below, pressure duct 46 is positioned downstream from vacuum duct 44 in the direction 48 substrate 24 moves past the printheads so that a stream of pressurized air can be directed into the flow of air carrying aerosol along the moving web 24.

Figure 3:
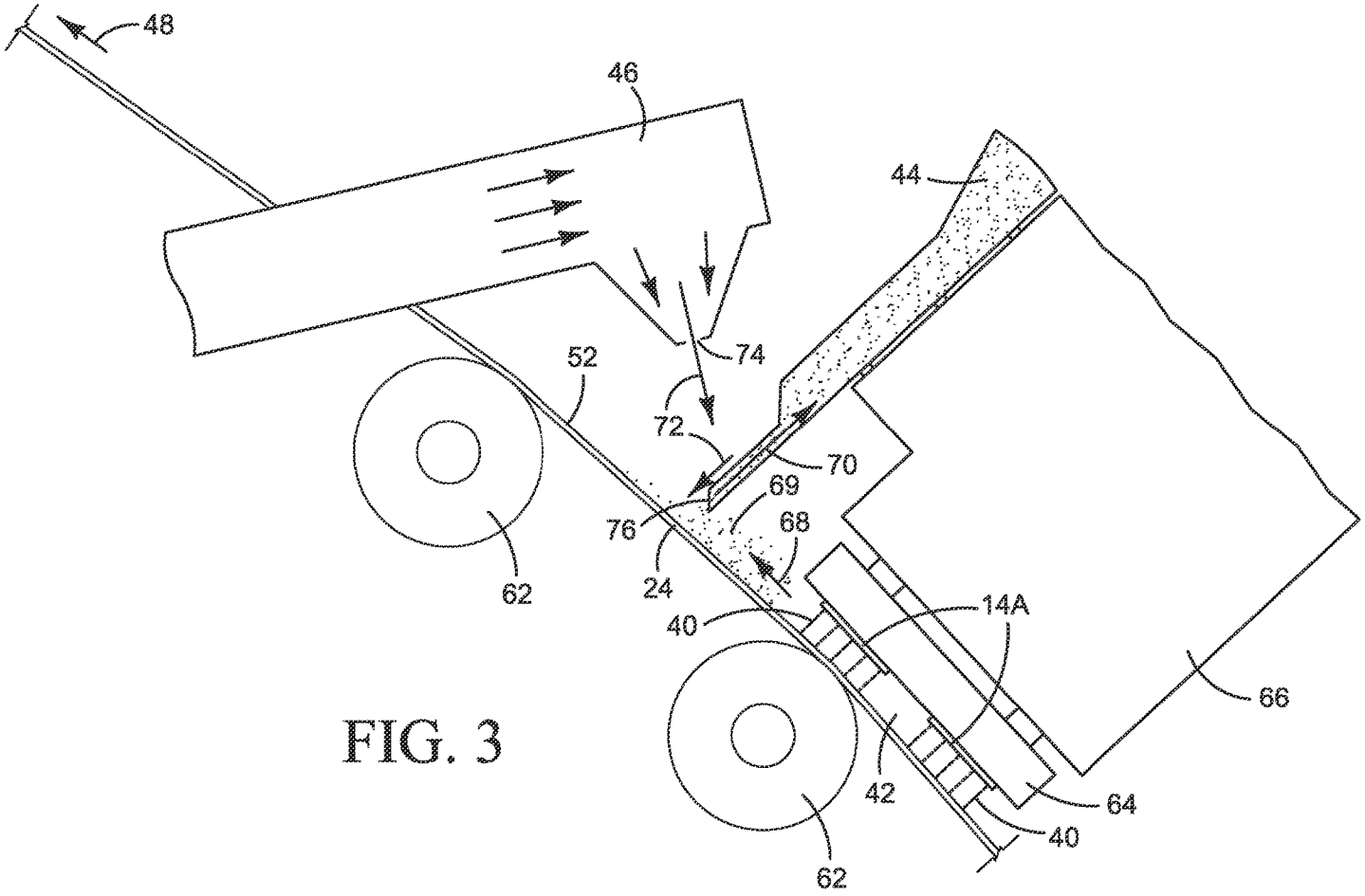
FIGS. 3 and 4 are an elevation and perspective, respectively, illustrating one example of an aerosol control system with vacuum and pressure ducts, such as might be implemented in the printers shown FIGS. 1 and 2.
Figure 4:
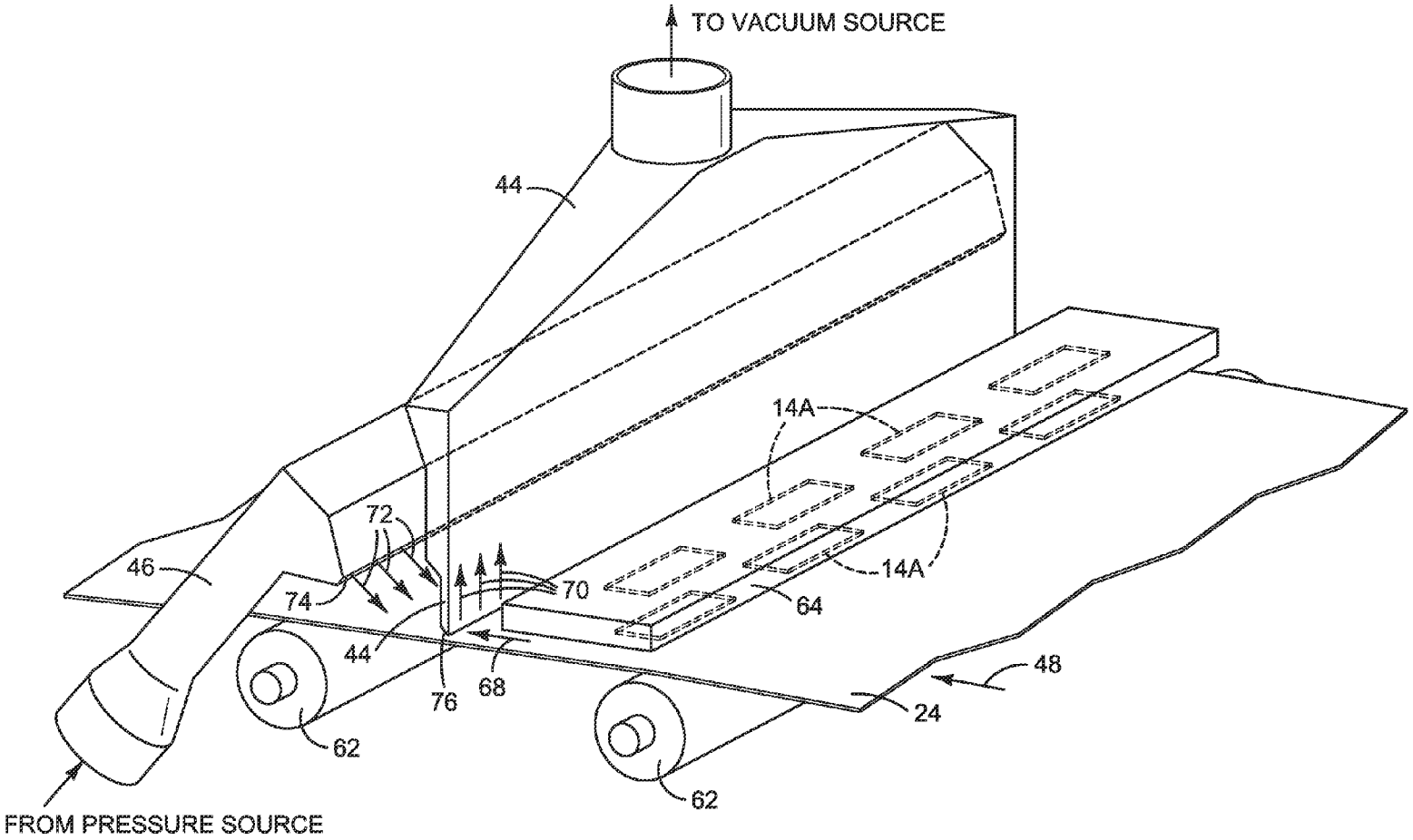

FIGS. 3 and 4 present a more detailed view illustrating one example of an aerosol control system 12 with vacuum and pressure ducts 46, 48 such as might be implemented in a printer 10 shown FIGS. 1 and 2. Referring to FIGS. 3 and 4, print substrate web 24 moves over rollers 62 past a print bar 64 mounted to a frame 66 and holding, for example, bonding agent (BA) printheads 14A. Air entrained by the moving web 26 is indicated with flow arrow 68. Aerosol is indicated by stippling 69. Air flow into vacuum duct 44 is indicated by flow arrow 70. Air flow from pressure duct 46 is indicated by flow arrow 72.

Pressure duct 46 is positioned downstream from vacuum duct 44. That is to say, the outlet 74 from pressure duct 46 is downstream from the intake 76 to vacuum duct 44. Pressure duct 44 terminates at a narrow, elongated outlet 74 to form an air knife 78 that, when pressurized, discharges a sheet of air 72 across the width of substrate web 24. In this example, as best seen in FIG. 3, air 72 is directed against the downstream side of vacuum duct 44, near vacuum intake 76 positioned close to the printed side 52 of substrate 24. Air 72 moves down duct 44 to intersect web air 68 and aerosol 69 at intake 76. Discharge air 72 forms a wall of air that interrupts the flow and entrainment of air 68 at intake 76, allowing vacuum duct 44 more time to more easily suck up aerosol 69. Discharge air 72 also dilutes the downstream flow of any aerosol 69 not captured by vacuum duct 44.

Testing shows that discharging air 72 against the downstream side of vacuum duct 44, as shown in FIG. 3, establishes a flow of air down and around the end of duct 44 and into the oncoming air 68 where the mixture is sucked into duct 44 through intake 76. Although the exact mechanism is not completely understood, this air flow 72 appears to reduce aerosol swirling immediately downstream of print bar 64 so that more aerosol can be pulled more quickly into duct 44.

Figure 5:
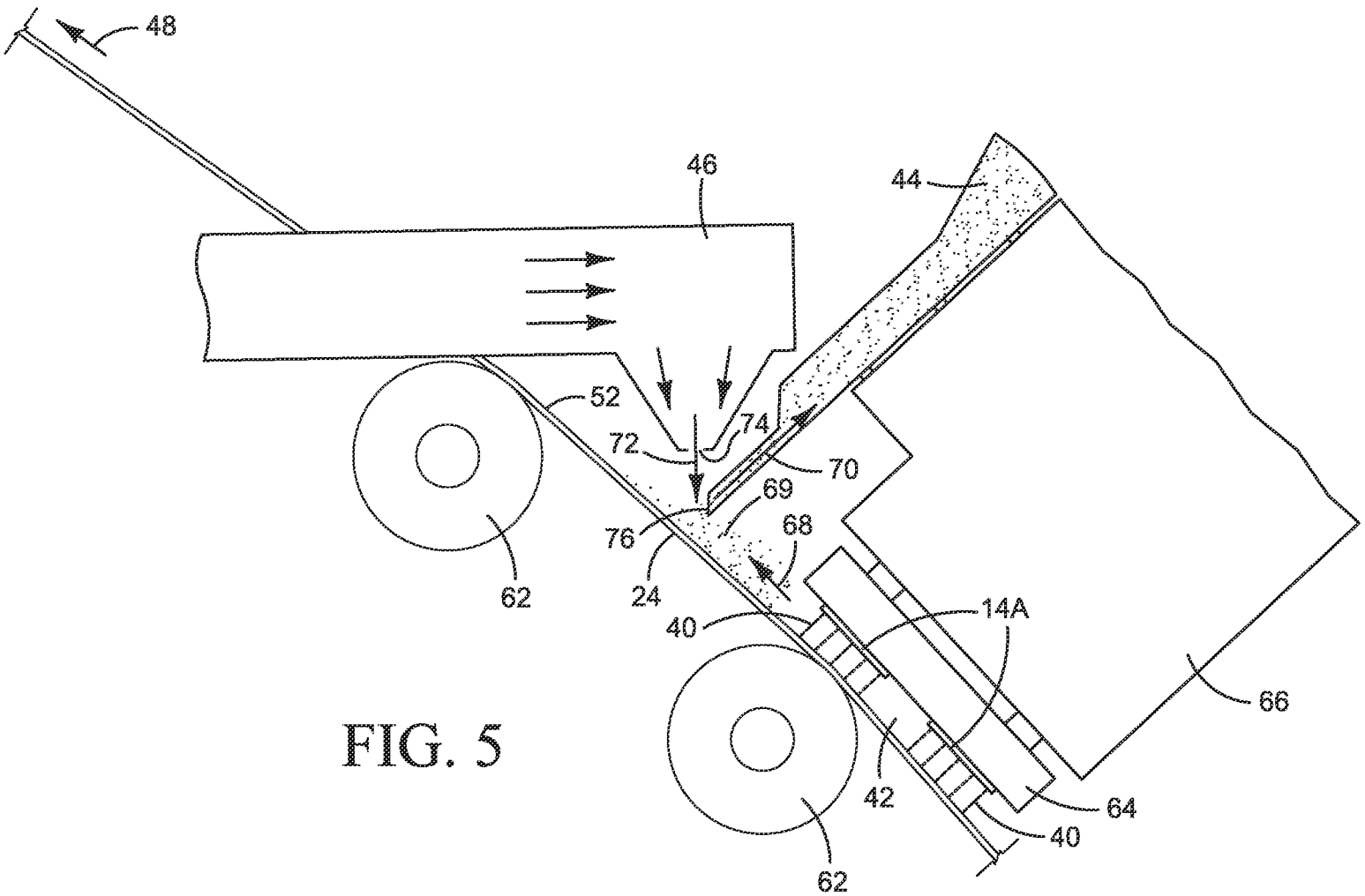
FIG. 5 is an elevation illustrating another example of an aerosol control system with vacuum and pressure ducts, such as might be implemented in the printers shown FIGS. 1 and 2.

In another example, shown in FIG. 5, air sheet 72 is discharged directly into the oncoming air 68 near vacuum intake 76. In this example, the sheet of air 72 is discharged directly into oncoming air 68 to help stall the flow of air 68 at intake 76.

Figure 6:
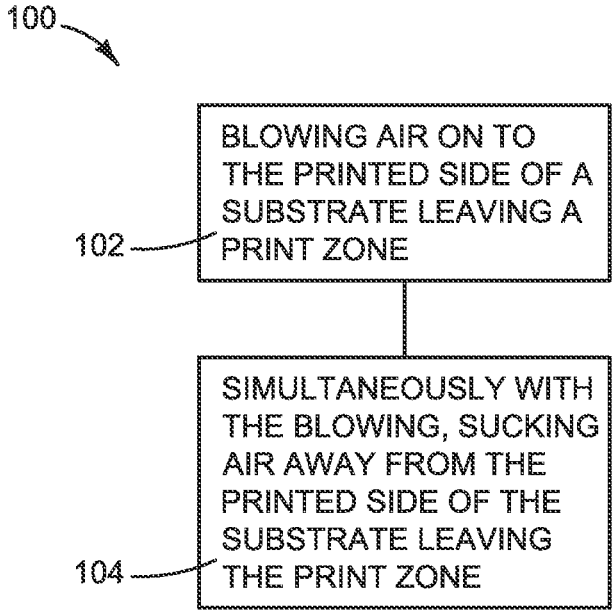
FIG. 6 is a flow diagram illustrating one example of a process for aerosol control.

FIG. 6 is a flow diagram illustrating one example of a process 100 for aerosol control such as might be implemented using one of the aerosol control system examples shown in FIGS. 3-5. Referring to FIG. 6, aerosol control process 100 includes blowing air on to the printed side of a substrate leaving a print zone (block 102) and simultaneously sucking air away from the printed side of the substrate leaving the print zone (block 104). In one example, the blowing and sucking include blowing air on to and sucking air away from the substrate at the same location, for example as shown in FIGS. 3-5. In one example, the blowing at block 102 in FIG. 6 includes blowing air upstream on to the print substrate toward the print zone, for example as shown in FIGS. 3-5.

Generating a high flow vacuum such as that needed for aerosol control in a large inkjet web press is more expensive than generating a high flow of pressurized air. An aerosol control system that combines blowing and sucking, for example as shown in the figures, allows more effective aerosol control with lower levels of vacuum compared to sucking alone (lower vacuum pressures and/or lower flow rates), thus creating an opportunity for cost savings. Also, the flow of air generated by vacuum alone is sensitive to the distance between the surface of the web and the intake to the vacuum duct. Discharging air into the oncoming flow along the web, for example as described above, reduces the sensitivity of the vacuum to the distance between the surface of the web and the intake to the vacuum duct, thus enabling the use of print bar configurations that are not unduly constrained by the height of the vacuum intake.

As noted at the beginning of this Description, the examples shown in the figures and described above illustrate but do not limit the scope of the patent. Other examples are possible. Therefore, the foregoing description should not be construed to limit the scope of the patent, which is defined in the following Claims.

"A" and "an" as used in the Claims means one or more.

What is claimed is:

1. An aerosol control system for a printer, comprising:

a vacuum duct through which air may be sucked away from a printed side of a substrate leaving a print zone; and a pressure duct, distinct from the vacuum duct, through which air may be blown on to the printed side of the substrate leaving the print zone, the pressure duct positioned downstream from the vacuum duct and configured to blow air diagonally upstream directly on to the substrate at the same location the vacuum duct is to suck air away from the substrate.

2. The system of claim 1, comprising:

a source of vacuum to suck air through the vacuum duct away from the printed side of the substrate; and a source of pressure to blow air through the pressure duct on to the printed side of the substrate simultaneously with sucking air through the vacuum duct.

3. The system of claim 1, where each duct spans a full width of the print zone.

4. An aerosol control system for a printer, comprising:

a vacuum duct through which air may be sucked away from a printed side of a substrate leaving a print zone; and a pressure duct, distinct from the vacuum duct, through which air may be blown on to the printed side of the substrate leaving the print zone, the pressure duct positioned downstream from the vacuum duct and configured to blow air diagonally upstream against a downstream side of the vacuum duct.

5. An aerosol control system for a printer, comprising:

an air knife to discharge a sheet of air into a flow of aerosol along a moving print substrate web; and a vacuum near the air knife to suck up aerosol from the flow simultaneously with the air knife discharging air into the flow; and where an outlet from the air knife is downstream from an intake to the vacuum and configured to discharge the sheet of air diagonally upstream directly on to the substrate at the same location the vacuum is to suck up aerosol.

6. The system of claim 5, where the outlet from the air knife and the intake to the vacuum are positioned between printheads in a direction the web moves through a printer.

7. The system of claim 6, where the outlet from the air knife and the intake to the vacuum are positioned upstream from a printhead that is to dispense a bonding agent and upstream from a printhead that is to dispense an ink.

8. A process to control aerosol in a printer, comprising simultaneously sucking air away from a printed side of a substrate leaving a print zone and blowing air diagonally upstream directly on to the substrate at the same location air is sucked away from the substrate.

9. The system of claim 4, comprising:

a source of vacuum operatively connected to the vacuum duct; and a source of pressure operatively connected to the pressure duct.

10. The system of claim 4, where each duct spans a full width of the print zone.

11. An aerosol control system for a printer, comprising:

an air knife to discharge a sheet of air into a flow of aerosol along a moving print substrate web; and a vacuum near the air knife to suck up aerosol from the flow simultaneously with the air knife discharging air into the flow; and where an outlet from the air knife is downstream from an intake to the vacuum and configured to discharge the sheet of air diagonally upstream against a downstream side of the intake to the vacuum.

12. The system of claim 11, where the outlet from the air knife and the intake to the vacuum are positioned between printheads in a direction the web moves through a printer.

13. The system of claim 12, where the outlet from the air knife and the intake to the vacuum are positioned upstream from a printhead that is to dispense a bonding agent and upstream from a printhead that is to dispense an ink.

* * * * *